US007646679B2

(12) United States Patent
Gil et al.

(10) Patent No.: US 7,646,679 B2
(45) Date of Patent: Jan. 12, 2010

(54) IRREGULAR DISPLAY MECHANISM FOR A TIMEPIECE

(75) Inventors: Ramon Gil, Bellevue (CH); Jean-Claude Quenet, Chambrelien (CH)

(73) Assignee: Franck Müller Watchland S.A. (CH)

( * ) Notice: Subject to any disclaimer, the term of this patent is extended or adjusted under 35 U.S.C. 154(b) by 84 days.

(21) Appl. No.: 11/943,953

(22) Filed: Nov. 21, 2007

(65) Prior Publication Data

US 2008/0151699 A1 Jun. 26, 2008

(30) Foreign Application Priority Data

Dec. 20, 2006 (CH) ..... 2067/06

(51) Int. Cl.
*G04B 19/00* (2006.01)

(52) U.S. Cl. ..... 368/223

(58) Field of Classification Search ..... 368/11, 368/80, 64, 66, 110, 204, 76, 220, 221, 223–238
See application file for complete search history.

(56) References Cited

U.S. PATENT DOCUMENTS

| | | | | |
|---|---|---|---|---|
| 4,494,879 | A * | 1/1985 | Meisner | 368/76 |
| 4,866,684 | A * | 9/1989 | Besson | 368/108 |
| 5,999,496 | A * | 12/1999 | Chaut | 368/223 |
| 7,170,826 | B2 * | 1/2007 | Furukawa et al. | 368/80 |
| 7,496,003 | B2 * | 2/2009 | Muller | 368/228 |
| 2004/0190381 | A1 * | 9/2004 | Tokoro et al. | 368/110 |
| 2005/0128875 | A1 * | 6/2005 | Bron | 368/21 |
| 2005/0232085 | A1 * | 10/2005 | Scheufele | 368/37 |
| 2005/0281136 | A1 * | 12/2005 | Wilmouth et al. | 368/28 |
| 2006/0007787 | A1 * | 1/2006 | Born et al. | 368/15 |
| 2007/0019507 | A1 * | 1/2007 | Gabathuler et al. | 368/28 |
| 2008/0106979 | A1 * | 5/2008 | Bron et al. | 368/34 |

FOREIGN PATENT DOCUMENTS

| | | |
|---|---|---|
| CH | 694 349 | 11/2004 |

* cited by examiner

*Primary Examiner*—Edwin A. Leon
(74) *Attorney, Agent, or Firm*—Ostrolenk Faber LLP

(57) ABSTRACT

A display mechanism is described, driven by the hour wheel of a mechanical or quartz horological movement, the hour wheel driving a cam controlling a rack turning about an axis and arranged in engagement with a pinion, secured to an hour hand, the cam having a configuration allowing different spaces or angles between the hours to be displayed.

11 Claims, 1 Drawing Sheet

IRREGULAR DISPLAY MECHANISM FOR A TIMEPIECE

TECHNICAL FIELD

The object of the invention is an irregular display mechanism for a timepiece intended to be driven by a base wheel of a horological movement intended to display a series of indications or data in relation to time or data relating to the functioning of the timepiece, such as the power reserve left.

Base wheel of the horological movement means any wheel intended to control a hand or disc or any device indicating the time, in particular any wheel intended to control the display of the seconds, the minutes, the hours, the date, the day, the week, the month, the phases of the moon or the year, etc, or data relating to the functioning of the timepiece such as the power reserve left.

PRIOR ART

Typically, the various quantities displayed by a timepiece are associated with graduations distributed regularly over a display sector, generally carried by the dial, and which can extend over less than 360 degrees.

By way of example, the patent CH 694 349 A5 in the name of the applicant describes a retrograde display mechanism for a timepiece by means of which two indicator hands are driven continuously, each from a cam controlling the pivoting of a lever carrying a rack arranged in engagement with a pinion carrying the corresponding hand. A spring acts on each lever in order to hold a finger that it carries against the periphery of the corresponding cam, thus defining the indication position of the associated hand.

DISCLOSURE OF THE INVENTION

An aim of the present invention is to propose a display mechanism for a timepiece, of the same type, by virtue of which the display can be effected atypically, in particular to adapt to certain particularities of the current lifestyle of humans.

To this end, the irregular display mechanism according to the invention is characterised by the fact that the periphery of the cam is arranged so that a rotation of the cam by a given rotation angle causes a variable movement of the display member dependent on the angular position of the cam with reference to the frame.

The cam can be mounted on a wheel driven by an intermediate setting wheel meshing with the base wheel.

The elastic means can comprise a pre-stressed spiral spring, a first end of which is fixed while its second end is secured to a wheel having a kinematic connection with the pinion.

According to a preferred embodiment the base wheel is the hour wheel of the horological movement, the rack meshing with a pinion indicating the hours carrying a hand travelling over a series of hours irregularly disposed on a dial of the timepiece according to the configuration of the cam.

By virtue of such a mechanism, the display of the hours can be adapted to the customary occupations of humans. Thus it is possible to provide, for example, for the display of the hours between midday and two o'clock to extend over a larger angular sector than the rest of the indications of the hours in order to give the wearer of the timepiece the impression that he has available a lot of time to take his meal at lunchtime.

The mechanism can be used to display the seconds, the minutes, the hours, the date, the day, the week, the month, the phases of the moon, the year, a greater time space or data relating to the functioning of the timepiece, such as the power reserve left.

It is possible to provide, by way of illustration, for the movement for a timepiece intended to receive the display mechanism of the invention to have a power reserve of several days. The mechanism, or more particularly its cam, can then be adapted to display the value of the power reserve left on a larger angular sector for the last day than for the others, so as to more easily attract the attention of the wearer of the timepiece to the imminence of the stoppage of the movement.

BRIEF DESCRIPTION OF THE DRAWINGS

The drawing shows by way of example an embodiment of a mechanism according to the invention.

In the drawing.

EMBODIMENT(S) OF THE INVENTION

Figure 2:
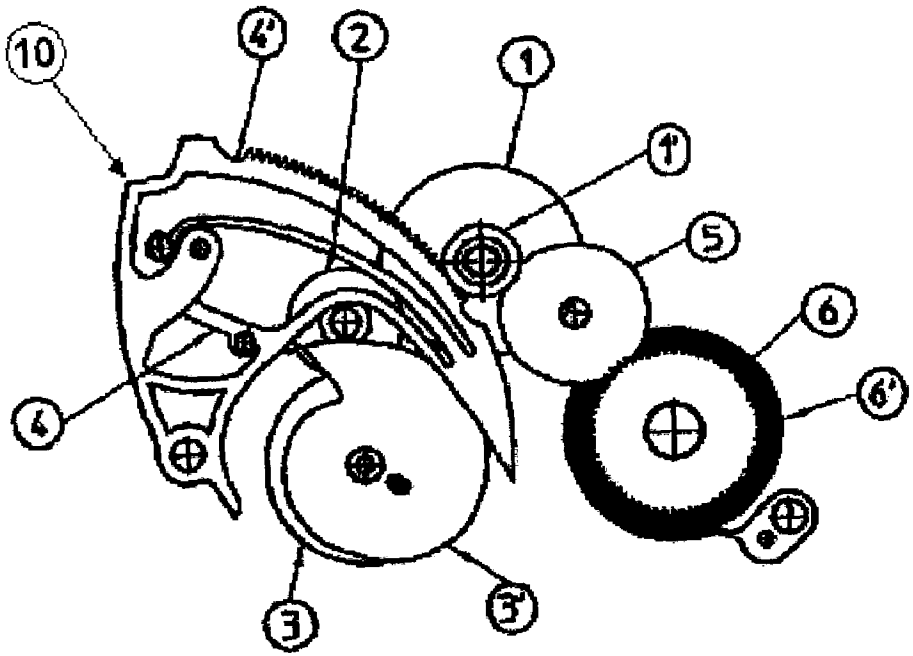
FIG. 2 is a view of a display mechanism intended to display the time shown at the centre of the dial in FIG. 1.

In the mechanism shown in FIG. 2, the base wheel of the horological movement bears the reference number 1 and is the hour wheel.

The base wheel 1 transmits the movement to a setting wheel 2, which transmits its rotation movement to a wheel 3 secured to a cam 3'. The wheel 1, the setting wheel 2 and the wheel 3 are produced so that the wheel 3 and consequently the cam 3' make one turn while the wheel 1 makes one turn.

A lever 10, pivotally mounted on a frame element (not shown) of the movement, carries a rack 4' and a finger 4 disposed in abutment against the periphery of the cam 3', defining an indication position of the lever. The cam 3' has a periphery in the irregular shape of a snail, or more precisely the radius of curvature of which does not vary regularly, giving rise to an irregular movement of the rack 4', by means of the finger 4, this irregular movement being transmitted to the pinion 1'. The latter is arranged in engagement with a setting wheel 5 kinematically connected to elastic means acting on the pinion, namely a wheel 6 secured to a pre-stressed spiral spring 6'. The effect of the pre-stressing of the spiral spring is to hold the lever in its indication position, that is to say with its sensing finger in abutment against the periphery of the cam.

It should be noted that the display mechanism described and depicted is of the retrograde type, the lever pivoting between two extreme positions respectively associated with the smallest and largest radii of the cam.

Figure 1:
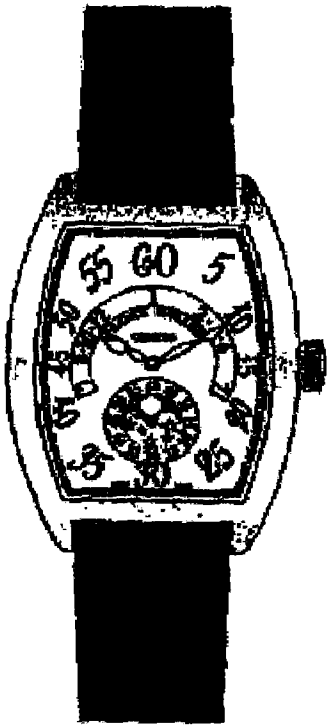
FIG. 1 is a view of a timepiece having a dial affording an irregular display of the hours.

In addition, the pinion 1' carries an hour hand, depicted in FIG. 1 of the drawing, travelling over an irregular display of the hours placed at the centre of the dial.

A person skilled in the art will not encounter any particular difficulty in implementing the display mechanism that has just been described and adapting it to his own requirements, without departing from the scope of the present invention. It is clear in fact from the present invention that an irregular progression of the curvature of the cam 3' makes it possible to obtain an irregular display of the hours, as depicted in FIG. 1 of the drawing.

As mentioned above, the mechanism can also be used to display data other than the hours, such as for example the seconds, the minutes, the years, the months, the phases of the moon, or a quantity relating to the functioning of the timepiece such as the power reserve left. Finally, the mechanism can be used with any mechanical or quartz timepiece.

What is claimed is:

1. A display mechanism for a timepiece, arranged to be driven from a base wheel of a horological movement for controlling movements of a member displaying an indication relating to time or to functioning of said timepiece in connection with graduations indicating values located apart from each other with a predefined movement amplitude of said display member to travel from one to another of said values, said display mechanism comprising a cam having a periphery of predefined shape and driven by said base wheel, said periphery having a continuous main portion, extending between a smallest radius and a largest radius with an irregular radius of curvature, and a transition portion linking said smallest radius to said largest radius, a lever mounted so as to pivot, with reference to a frame element of said horological movement, between first and second extreme positions associated with predefined values of said indication, said lever carrying a sensing finger engaged with said periphery of said cam in order to define an indication position at a given moment, said lever also carrying a rack arranged in engagement with a pinion arranged to drive said display member, at least one elastic organ exerting a force on said lever in order to tend to position it in said indication position, said graduations being designed such that said predefined movement amplitude of said display member to travel between two consecutive values varies along said graduations, according to said irregular radius of curvature of said cam periphery, such that a rotation of said cam by a given rotation angle causes a variable movement of said display member dependent on the angular position of said cam with reference to said frame.

2. The display mechanism of claim 1, wherein said cam is secured to a wheel driven by a setting wheel having a kinematic connection with said base wheel.

3. The display mechanism of claim 1, wherein said at least one elastic organ comprises at least one pre-stressed spiral spring, a first end of which is fixed while its second end is secured to a wheel having a kinematic connection with said pinion.

4. A horological movement for a timepiece comprising a base wheel, driven according to an indication relating to time or to functioning of said horological movement, and a display mechanism for controlling movements of a display member for indicating a quantity representing said indication relating to time or functioning of said horological movement in connection with graduations indicating values located apart from each other with a predefined movement amplitude of said display member to travel from one to another of said values, said display mechanism comprising a cam having a periphery of predefined shape and driven by said base wheel, said periphery having a continuous main portion, extending between a smallest radius and a largest radius with an irregular radius of curvature, and a transition portion linking said smallest radius to said largest radius, a lever mounted so as to pivot, with reference to a frame element of said horological movement, between first and second extreme positions associated with predefined values of said indication, said lever carrying a sensing finger engaged with said periphery of said cam in order to define an indication position at a given moment, said lever also carrying a rack arranged in engagement with a pinion arranged to drive said display member, at least one elastic organ exerting a force on said lever in order to tend to position it in said indication position, said graduations being designed such that said predefined movement amplitude of said display member to travel between two consecutive values varies along said graduations, according to said irregular radius of curvature of said cam periphery, such that a rotation of said cam by a given rotation angle causes a variable movement of said display member dependent on the angular position of said cam with reference to said frame.

5. The movement of claim 4, wherein said at least one elastic organ comprises at least one pre-stressed spiral spring, a first end of which is fixed while its second end is secured to a wheel having a kinematic connection with said pinion.

6. The movement of claim 4, wherein said base wheel is an hour wheel, said pinion being arranged to drive a member displaying hour in an irregular manner according to current time.

7. The movement of claim 4, wherein said base wheel is arranged to display seconds, minutes, hours, date, day of the week, week, month, phases of the moon, year, a larger space of time, or an indication relating to time or to functioning of said timepiece, such as power reserve.

8. A timepiece comprising a case housing a horological movement and at least one display member, movements of which are controlled by said horological movement in order to display a quantity taken from a group comprising seconds, minutes, hours, date, day, week, month, phases of the moon, year, etc, or data relating to functioning of said timepiece, said horological movement comprising a base wheel, driven according to an indication relating to time or to functioning of said horological movement in connection with graduations indicating values located apart from each other with a predefined movement amplitude of said display member to travel from one to another of said values, and a display mechanism for controlling movements of said display member and comprising a cam having a periphery of predefined shape and driven by said base wheel, said periphery having a continuous main portion, extending between a smallest radius and a largest radius with an irregular radius of curvature, and a transition portion linking said smallest radius to said largest radius, a lever mounted so as to pivot, with reference to a frame element of said horological movement, between first and second extreme positions associated with predefined values of said indication, said lever carrying a sensing finger engaged with said periphery of said cam in order to define an indication position at a given moment, said lever also carrying a rack arranged in engagement with a pinion arranged to drive said display member, at least one elastic organ exerting a force on said lever in order to tend to position it in said indication position, said graduations being designed such that said predefined movement amplitude of said display member to travel between two consecutive values varies along said graduations, according to said irregular radius of curvature of said cam periphery, such that a rotation of said cam by a given rotation angle causes a variable movement of said display member dependent on the angular position of said cam with reference to said frame.

9. The timepiece of claim 8, wherein said at least one elastic organ comprises at least one pre-stressed spiral spring, a first end of which is fixed while its second end is secured to a wheel having a kinematic connection with said pinion.

10. The timepiece of claim 8, wherein said base wheel is an hour wheel, said pinion being arranged to drive a member displaying hour in an irregular manner according to current time.

11. The timepiece of claim 8, wherein said base wheel is arranged to display an indication relating to time or to functioning of said timepiece, such as power reserve.

* * * * *